US008579460B2

(12) United States Patent
Wilson et al.

(10) Patent No.: US 8,579,460 B2
(45) Date of Patent: Nov. 12, 2013

(54) LED FLARE AND SYSTEM

(75) Inventors: Troy Wilson, Minden, NV (US); Chuan Zhong He, Shenzhen (CN)

(73) Assignee: Aervoe Industries, Inc., Gardnerville, NV (US)

( * ) Notice: Subject to any disclaimer, the term of this patent is extended or adjusted under 35 U.S.C. 154(b) by 263 days.

(21) Appl. No.: 13/049,761

(22) Filed: Mar. 16, 2011

(65) Prior Publication Data

US 2012/0236548 A1 Sep. 20, 2012

(51) Int. Cl.
*F21L 4/00* (2006.01)

(52) U.S. Cl.
USPC ..... 362/183; 362/473

(58) Field of Classification Search
USPC ..... 362/183, 473
See application file for complete search history.

(56) References Cited

U.S. PATENT DOCUMENTS

| | | | | |
|---|---|---|---|---|
| 4,282,562 | A * | 8/1981 | Marino | 362/183 |
| 4,926,300 | A | 5/1990 | Ralston | |
| 5,081,568 | A | 1/1992 | Dong | |
| 6,486,797 | B1 | 11/2002 | Laidman | |
| D515,958 | S | 2/2006 | Dueker | |
| 7,088,222 | B1 * | 8/2006 | Dueker et al. | 340/321 |
| 7,261,456 | B2 | 8/2007 | Liu | |
| D560,533 | S | 1/2008 | Dueker | |
| 7,784,204 | B2 | 8/2010 | Staats et al. | |
| 8,147,087 | B2 | 4/2012 | Chen | |
| 2002/0105432 | A1 * | 8/2002 | Pederson et al. | 340/815.45 |
| 2002/0180616 | A1 | 12/2002 | Laidman | |
| 2002/0191396 | A1 * | 12/2002 | Reiff et al. | 362/246 |
| 2004/0130886 | A1 | 7/2004 | Lewis | |
| 2004/0145890 | A1 * | 7/2004 | Liao | 362/183 |
| 2007/0121332 | A1 | 5/2007 | Liu | |
| 2007/0176784 | A1 | 8/2007 | Fautin | |
| 2008/0036584 | A1 * | 2/2008 | Lang et al. | 340/473 |
| 2011/0096534 | A1 | 4/2011 | Lee | |
| 2012/0287611 | A1 * | 11/2012 | Wilson et al. | 362/183 |

* cited by examiner

*Primary Examiner* — Mary Ellen Bowman
(74) *Attorney, Agent, or Firm* — Watson Rounds; Marc D. Foodman

(57) ABSTRACT

A LED flare and system for use to provide greater visibility in any light conditions, particularly in low light. The flare comprises an elongated housing that is generally cylindrical with a flat side. It has a handle at one end and a plurality of LEDs positioned along the outer periphery. A switch located on the elongated housing operates the flare. The flare also includes a re-chargeable battery encased in the housing for powering the flare and a circuit for delivering power and operational control from the battery to the LEDs upon activation by the switch. A set of contacts positioned on the outside of the housing deliver a charge to the battery. The flare includes an attachment device for holding an external charger in place against the contacts during charging operation. An individual flare may be part of a system that also includes other flares and a carrying case with an integrated charger, one or more flare stands and charger accessories.

20 Claims, 8 Drawing Sheets

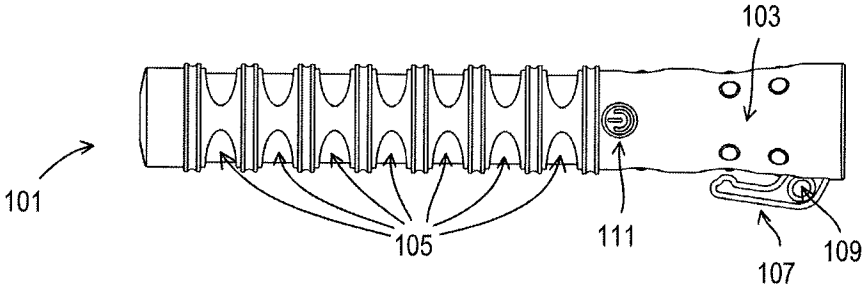
FIG. 1A
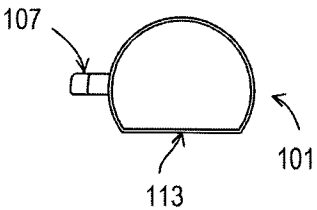
FIG. 1B
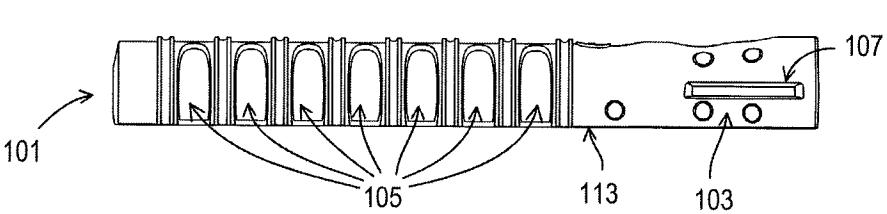
FIG. 1C
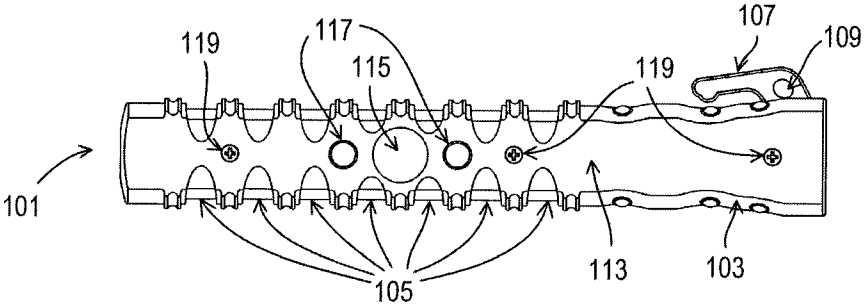
FIG. 1D
FIG. 1E

LED FLARE AND SYSTEM

CROSS-REFERENCE TO RELATED APPLICATIONS

The present Application is related to each of the following commonly-owned, co-pending U.S. patent application Ser. No. 29/387,692, filed Mar. 16, 2011, entitled "LED Flare." The entirety of the related Application above is incorporated by reference in the present Application.

BACKGROUND

Lighted batons or flashlights with illuminated covers are used by police, fire, airport workers, construction crews, emergency personnel and others to direct vehicles of all kinds at night, in low light conditions or even during the day where a lighted object provides greater visibility. The typical lighted baton is a standard flashlight with an elongated red plastic cover over the bulb that is visible by drivers and other vehicle operators.

A problem with these types of devices is that they do not lend themselves well to uses beyond directing traffic with the user holding the handle and waving the device in a particular direction. Additionally, devices of this type may not be durable to withstand harsh treatment such as being dropped on the ground or operating in inclement conditions such as very cold temperatures, rain, sleet or snow. More durable designs may suffer from being heavy and causing the user to tire during long periods of use. Further, the devices do not provide a way for the devices to be configured for use without a person holding it. Another shortcoming is that they are battery operated and require maintaining a backup set of batteries in the event that the batteries fail. In cases where the devices use rechargeable batteries, they must be removed from the unit and placed in a separate charger.

BRIEF DESCRIPTION OF THE DRAWINGS

FIGS. 1A-1G show a variety of views of a LED flare;

SPECIFICATIONS

Detailed Description

Figure 1G:
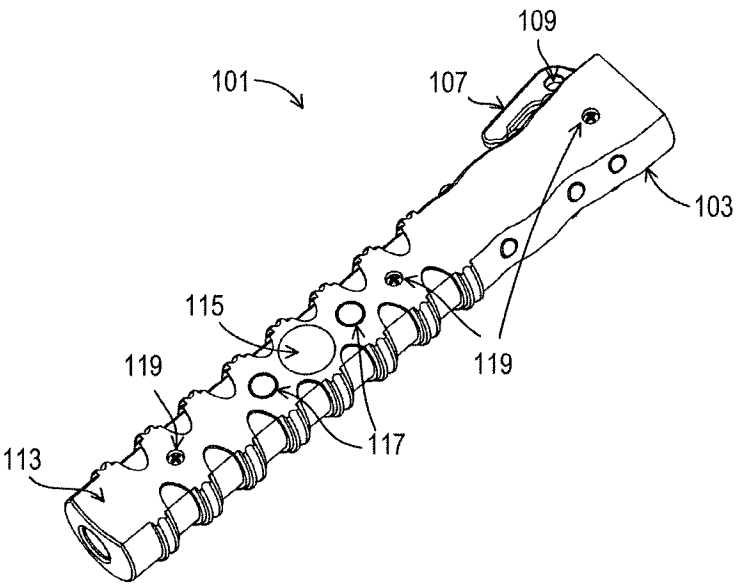

The present invention will now be described more fully with reference to the accompanying drawings. It should be understood that the invention may be embodied in many different forms and should not be construed as limited to the embodiments set forth herein. Throughout FIGS. 1-7, like elements of the invention are referred to by the same reference numerals for consistency purposes.

FIGS. 1A-1E show a variety of views of a LED flare 101. As can be seen in FIG. 1A, LED flare 101 has a body that is generally cylindrical in shape, with a handle 103 at one end and a series of LEDs 105 embedded along the sides of the cylindrical body. A hanger 107 is integrated into handle 103 for hanging LED flare 101 from any appropriate place including but not limited to a sign such as a stop sign or over the edge of a metal barrel. Hanger 107 may further be made with a hole 109 for hanging LED flare 101 from a string, a wire or a carabineer. A switch 111 is mounted in handle 103 to turn LED flare 101 on and off as well as perform other operational functions. A magnet (not shown) may be installed in the bottom of handle 103 to allow flare 101 to stick to metal objects.

The cylindrical body of LED flare 101 has a flat side 113 as can be seen in a top down view of LED flare 101 shown in FIG. 1B and a bottom up view of LED flare shown in FIG. 1C. FIG. 1D shows a view of LED flare 101 with flat side 113 down. In FIG. 1E, flat side 113 is shown facing out with an attachment device 115 shown in the middle of the body of LED flare 101. Attachment device 115 is preferably a magnet so that it can be easily and quickly attached, removed and re-attached to magnetic objects such as the side of vehicle or a metal sign without damaging the object to which it is attached. As an alternative, attachment device 115 may be one side of Velcro® type hook and loop fasteners or a reusable sticky material. A pair of charging posts 117 are shown situated on either side of magnet 115. Screws 119 hold the different pieces of the body of LED flare 101 together while charging posts 117 are used to connect a charger that recharges one or more re-chargeable batteries housed inside of the body of LED flare 101.

Figure 1F:
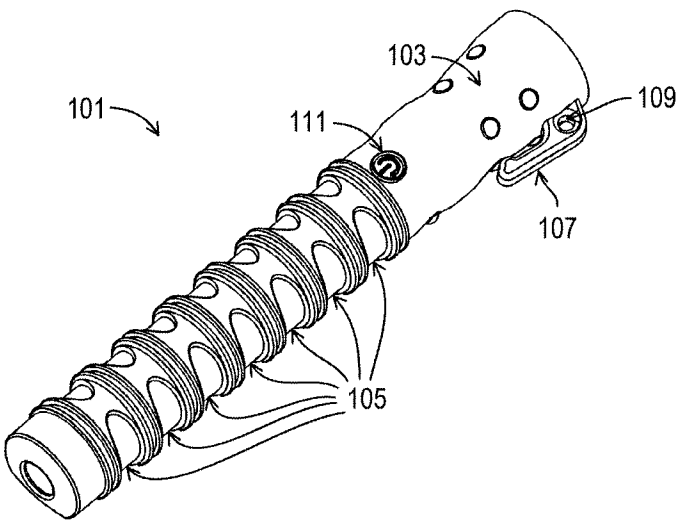

FIG. 1F is a perspective view of the rounded side of LED flare 101, and FIG. 1G is a perspective view of the flat side of LED flare 101. Flare 101 may be any length and diameter. In one embodiment, a length of 10.75 inches and a diameter of 1.75 inches at the bottom of handle 103 tapering to 1.5 inches at the top provides provide dimensions for a lightweight, durable and easy to use, store and carry flare 101. A configuration of 7 LEDs on each side works well for directing traffic or warning motorists. It should be recognized that configurations with more LEDs or fewer LEDs could be implemented without altering the operation of the flare.

Figures 2A, 2B:
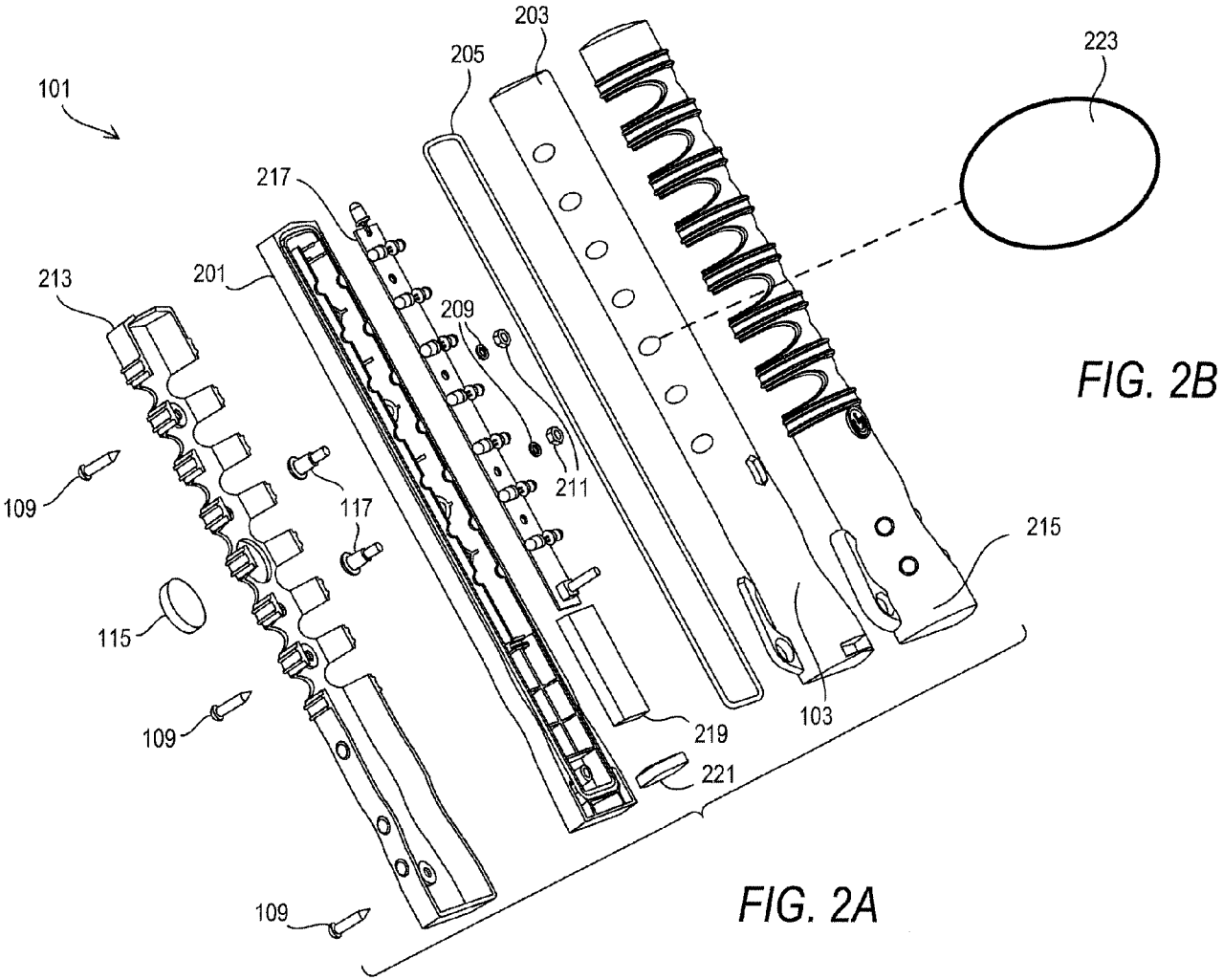
FIGS. 2A and 2B show exploded views of a LED flare including its component parts.

FIG. 2A is an exploded perspective view showing the individual components of LED Flare 101 in relative position to each other. Flare 101 has an elongated cylindrically shaped body formed from number of components including a clear hard plastic bottom panel 201 and a clear hard plastic top panel 203 that fit together with a seal ring 205 fitted between them to form a housing. Seal ring 205 resists water penetration into the interior of the housing when bottom panel 201 and top panel 203 are fitted together using binding posts 109 which may be screws, rivets or other attachment pins in combination with washers 209 and nuts or backs 211. Fitted over the body of flare 101 formed of bottom panel 201 and top panel 203 is a molded casing made of two parts, bottom case panel 213 and top case panel 215. Both case panels are made of a rubber material that is semi-rigid to allow for easy installation over the body of flare 101, while providing cushioning in the event that flare 101 is dropped or banged against a hard surface. The molded case also provides a texture over the body of flare 101 for easy grip.

Along the interior of the body of flare 101 is positioned a module 217 that is made up of a board onto which LEDs 105 and battery 219 are mounted. Module 217 is held in place by binding posts 109 that pass through module 217. Battery 219 is a rechargeable battery that is recharged through charging posts 117. Magnets 115 and 221 are also included along the body and in the base of handle 103 respectively, to allow flare 101 to be removably affixed to metal surfaces such as on the exterior of a vehicle.

FIG. 2B shows a close up view of a magnifying lens 223 that may be used in an alternative embodiment. Although not necessary, magnifying lenses may be formed in top panel 203 in front of one or more of the LEDs 105 along the body of flare 101. Magnifying lens 223 is round and convex in shape to magnify the light produced by LED 105 as it passes through the top panel 203 of flare 101. In another alternative embodiment, multiple LEDs may be located at each position along module 217 either adjacent to each other or stacked on top of each other. By locating two or more LEDs at each position, more light patterns can be made available during operation of flare 101.

Figure 3E:
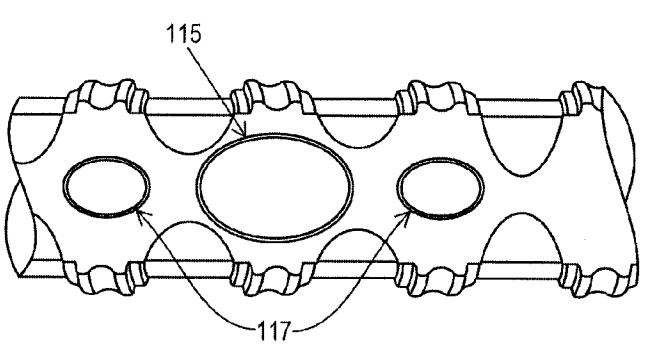
FIGS. 3A-3E show views of a charger with LED flare contacts.
Figure 3D:
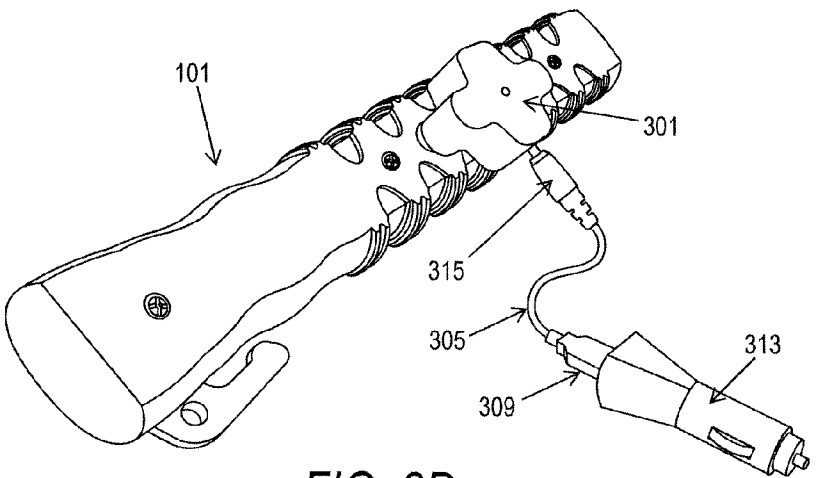
Figure 3B:
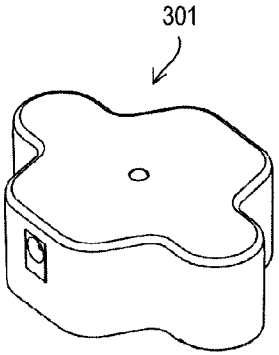
Figure 3C:
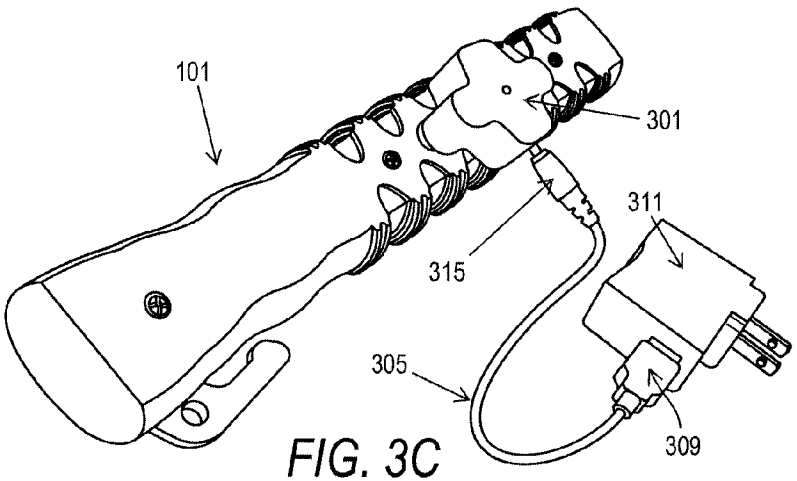
Figure 3A:
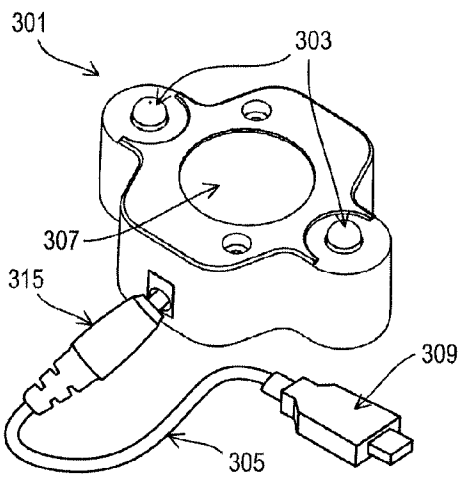

FIGS. 3A and 3B show a top and bottom perspective view, respectively, of a charger 301 with LED flare contacts 303. Charger 301 is used to charge batteries housed in the body of LED flare 101 by making contact with LED flare contacts 303. Charger 301 has a power cord 305 that may draw power either from an AC or DC source. An attachment device 307 such as a magnet is used to hold charger 301 in place against LED flare 101 during charging with contacts 303 aligned and in electrical connection with charging posts 117. Power cord 305 may include a USB type connector 309 that is adapted to be plugged directly into a USB port on a computer (not shown) or other device with a standard USB port to provide power to charger 301.

FIG. 3C shows charger 301 connected to LED flare 101 for charging. USB connector 309 may be connected to an AC adapter 311 that is plugged into a standard outlet. Alternatively, as shown in FIG. 3D, USB connector 309 may be connected to a DC adapter such as a standard vehicle lighter adapter 313 for drawing power from a car lighter. FIG. 3E shows a portion of flat side 113 of LED flare 101 with attachment device 115 and charging posts 117 that are configured to connect to charger 301 as shown in FIGS. 3A-3D. In FIGS. 3A-3C, power cord 305 is shown with an end having a removable connector 315 plugged into charger 301.

Figure 4C:
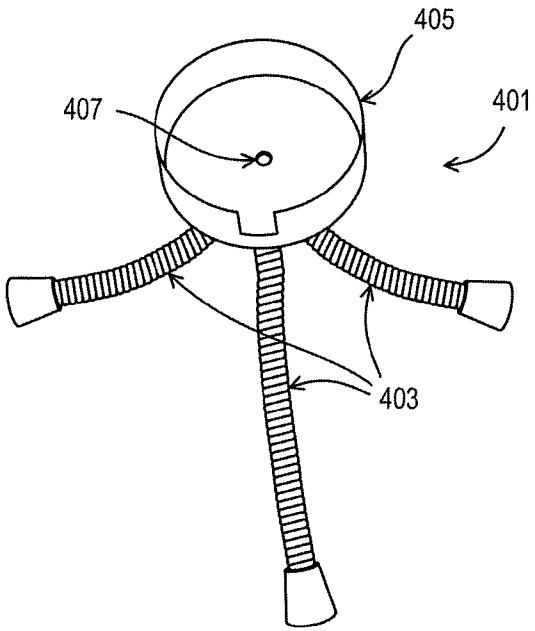
FIG. 4A-4C show views of a stand for use with the LED flare.
Figure 4B:
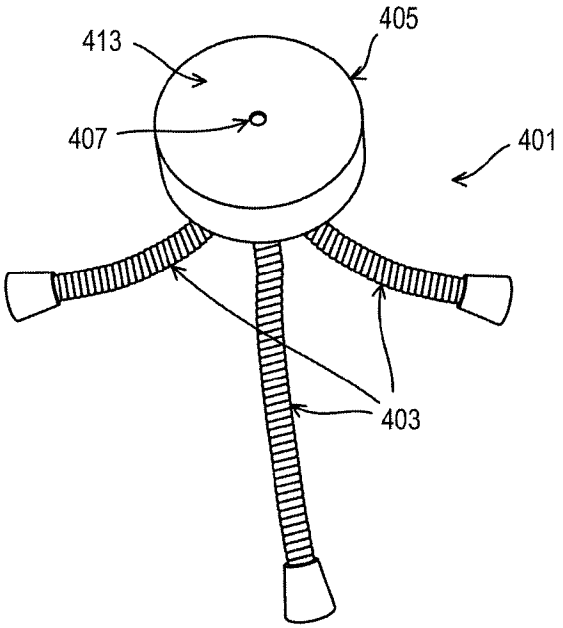
Figure 4A:
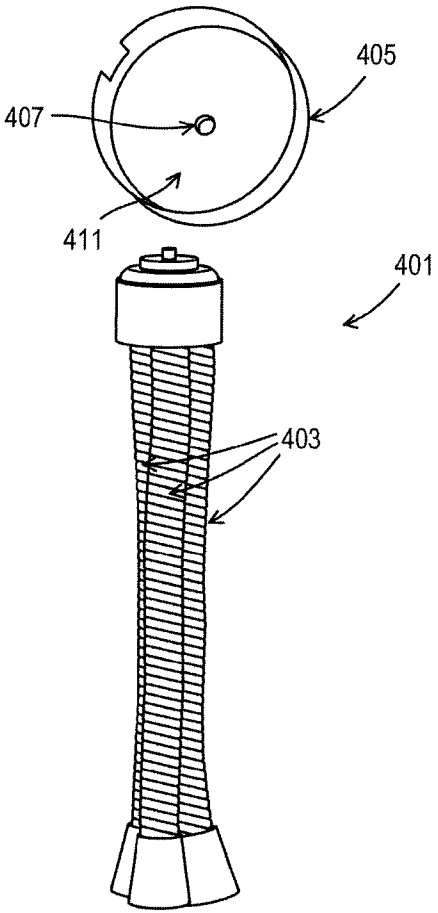

FIGS. 4A-4C show views of a stand 401 for use with LED flare 101. Stand 401 has a number of flexible legs 403 that can be twisted, bent or pulled into any position desired by a user. A metal cup 405 that is preferably a magnetic material is screwed to the top of stand 401 by engaging a threaded hole 407 at the center of cup 405 onto screw 409 protruding from the top of stand 401 where legs 403 are bound together. Cup 405 can be mounted with the opening facing up to hold flare 101 in the vertical position with a magnet in the base of handle 103 holding flare 101 firmly in place against the inner surface 411 of cup 405. Alternatively, cup 405 can be mounted with the opening facing down and flare 101 may be mounted horizontally by attaching magnet 115 to the outside surface 413 of cup 405.

Legs 403 are made of flexible metal or plastic that will hold any position. By twisting, bending or pulling the free ends of legs 401, a user can create any shape for stand 401 so that LED flare 101 is positioned as desired on any surface regardless of whether it is flat or inclined. When not in use, stand 401 and cup 405 can be separated by disengaging screw 409 from hole 407. Legs 403 can be straightened and pushed together to allow for easy storage of stand 401.

Figure 5B:
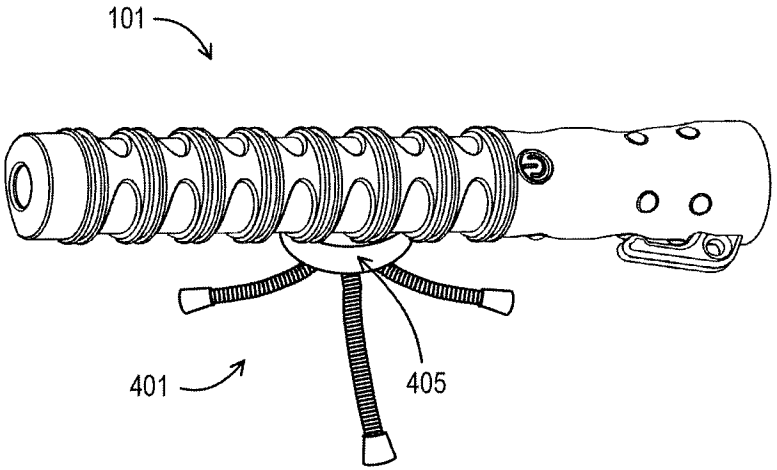
FIGS. 5A-5B show views of the stand holding the LED flare.
Figure 5A:
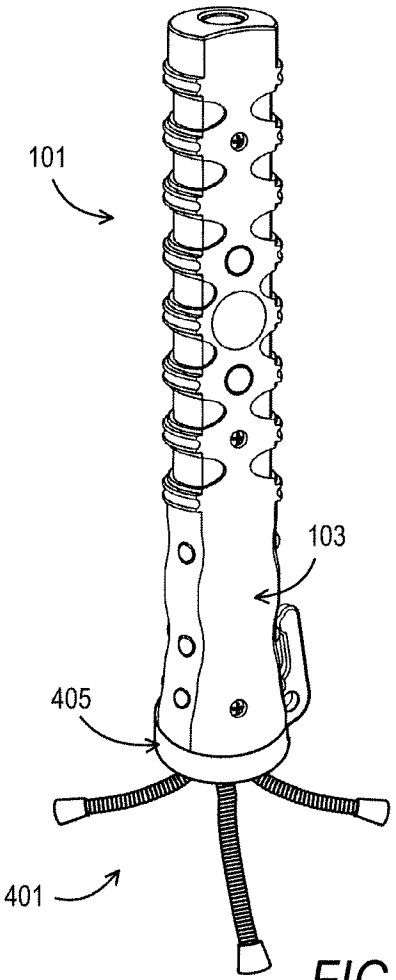

FIGS. 5A-5B show views of stand 401 in use with LED flare 101. In FIG. 5A, LED flare 101 is placed in a vertical position with handle 103 in cup 405. FIG. 5B shows cup 405 engaged on screw 409 with the opening of cup 405 in the down position so that magnet 115 sticks to cup 405 and holds LED flare 101 in place on stand 401 in a horizontal position.

Figure 6:
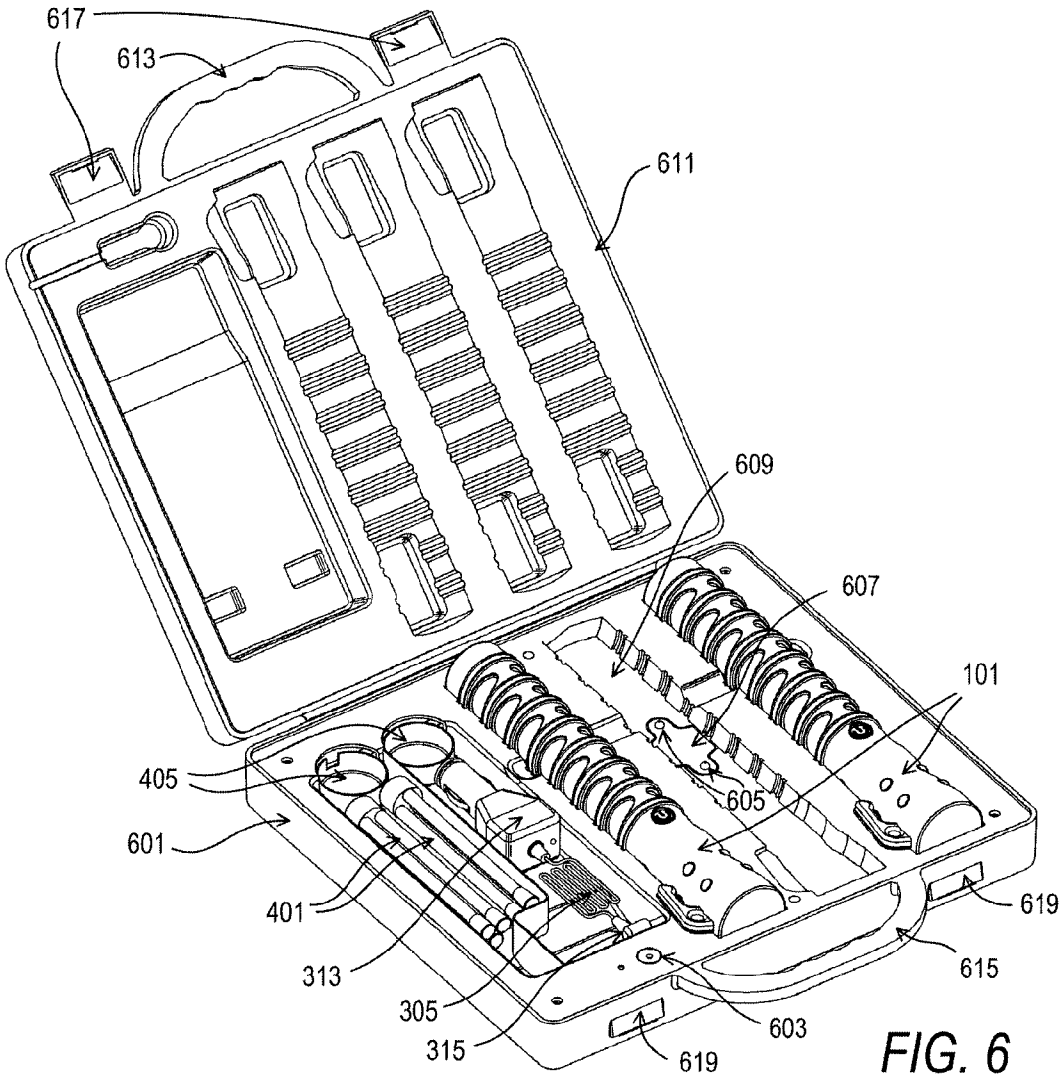
FIG. 6 is a perspective view of LED flares in a charger case with accessories.

FIG. 6 is a perspective view of a carrying case base 601 capable of holding three LED flares 101 with integrated charging for each LED flare 101, and storage areas for accessories including stands 401, DC adapter 313, power cord 305 and cups 405. Carrying case base 601 is equipped with integrated chargers to re-charge the batteries of LED flares 101 when placed in carrying case 601. Power cord 305 can be disconnected from charger 301, and used with the integrated chargers of carrying case 601 instead by plugging connector 315 into carrying case base connector 603. The other end of power cord 305 is then plugged into a power source such as a USB port on a computer, an AC outlet using AC adapter 311 or DC adapter 313. A pair of case charger contacts 605 are integrated into carrying case base 601 and function in the same manner as charger contacts 303, drawing power through power cord 305 that is connected into carrying case base 601 at case connector 603. An attachment device such as a magnet 607 holds flare 101 in place in a recessed slot 609 of carrying case base 601. Magnet 607 is particularly useful if charging is being performed with the case open and where there may be a chance of LED flare 101 being knocked out carrying case base 601, or to prevent rattling of LED flare 101 in carrying case base 601. It should be understood that charging may be performed on all flares in the case through the same type of layout under each flare in the carrying case.

In the embodiment shown in FIG. 6, carrying case base 601 has a hinged cover 611 with a cover handle 613 that lines up with base handle 615 when cover 611 is closed. Recessed slots in cover 611 are appropriately shaped, and aligned with recessed slots 609 in carrying case base 601 to hold LED flares 101 and the accessories firmly in place when carrying case base 601 is in the closed position. Cover 611 may be locked in place on carrying case 601 by snapping down clasps 617 over protrusions 619 on carrying case base 601.

Carrying case base 601 and cover 611 may be manufactured using molded plastic which is lightweight, hollow and durable. Wires (not shown) may be run inside of the hollow area in base 601 between connector 603 and charger contacts 605.

Figure 7:
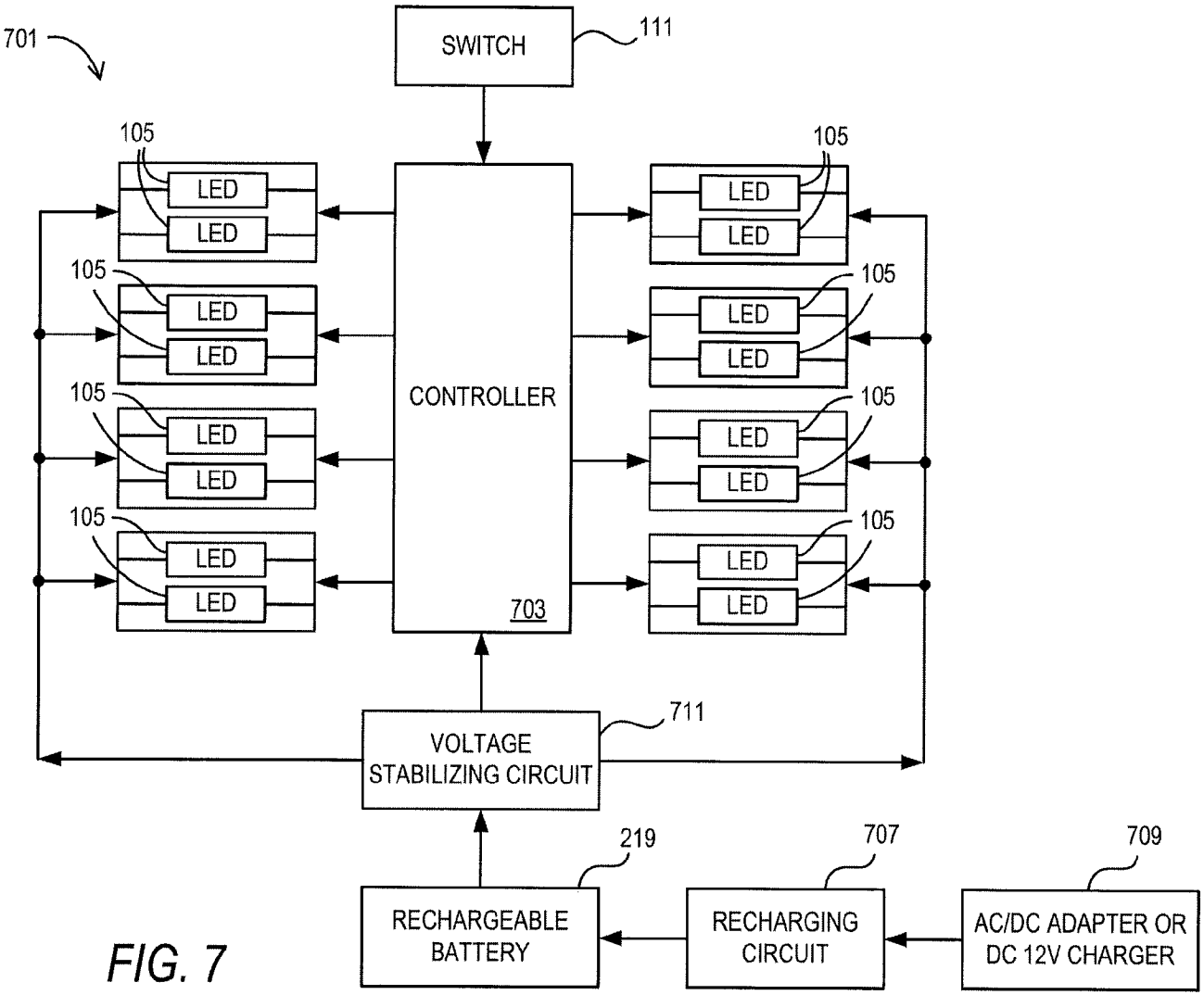
FIG. 7 is a block diagram of a circuit in the LED flare.

FIG. 7 is a block diagram of the circuit 701 encased within handle 103 of flare 101. Circuit 701 includes a controller 703 for controlling the operation of the multiple LEDs 105 housed within flare 101. Controller 703 is typically an integrated circuit and is programmed with one or more patterns for flashing and/or maintaining illumination of LEDs 105. Switch 111 is used to power on and power off flare 101. Switch 111 may also be used to cycle through any number of different light patterns of flare 101. For example, each LED 105 may be turned on for a fraction of a second in the sequential order as they are positioned along the length of flare 101. Alternatively, illumination may be set to alternate between LEDs 105 on either side of the housing of flare 101. A third option is to keep all LEDs turned on without blinking or flashing. It should be understood that the number of patterns possible and the timing sequences is only limited by the number of LEDs 105 that are used in flare 101.

Controller 703 is powered by re-chargeable battery 219, which in turn is recharged by a recharging circuit 707 connected to an adapter 709. Adapter 709 may be either an AC adapter 311 or a DC adapter 313 for supplying AC or DC to circuit 701 from a wall outlet, a cigarette lighter or another power source. A voltage stabilizing circuit 711 receives power supplied by battery 219 and delivers it directly to controller 703 and LEDs 105.

Operation of the invention will now be described with reference to FIGS. 1-7. Initially, flare 101 is powered off. Power is turned on by a user activating switch 111. Power is then delivered from battery 219 through voltage stabilizing circuit 711 to controller 703 and LEDs 105. Controller 703 is programmed with a number of different lighting patterns through which the LEDs are cycled turning them on and off in accordance with the programmed patterns. Each pattern may be used to indicate a signal such as an emergency of a particular type, or just to maintain all of the lights in an illuminated state so that a parked vehicle is visible at night or in low light conditions. To cycle through the different illumination patterns, the user simply depresses switch 111. Alternatively two switches could be implemented with one delivering power and the second for changing the light pattern.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined with reference to the claims.

What is claimed is:

1. An electrically powered flare comprising:
- an elongated housing formed of a generally cylindrical shape and having a flat side;
- a handle at one end of the elongated housing;
- a plurality of LEDs positioned in a plurality of corresponding windows on opposing sides along the length of the generally cylindrically shaped elongated housing, wherein each of the plurality of windows is spaced apart at discrete intervals along the length of the housing relative to other windows;
- a switch on the elongated housing for operating the flare;
- a re-chargeable battery encased in the elongated housing for powering the flare;
- a circuit having a controller encased in the elongated housing that is in electrical connection with the switch, the battery and the LEDs for delivering power and operational control from the battery to the LEDs upon activation by the switch, the controller programmed with a plurality of light patterns selected and displayed on the plurality of LEDs during operation of the flare;
- flare contacts mounted to the housing on the flat side of the elongated housing and electrically connected to the battery for delivering a charge to the battery;
- a flare attachment device recessed in the flat side of the housing and proximate to the contacts; and
- an external charger comprising:
  - a charger housing having a first side;
  - charger contacts mounted on the first side of the charger housing; and
  - a charger attachment device mounted proximate the charger contacts on the first side of the charger housing that aligns with the flare attachment device during charging operation such that the flare contacts on the flat side of the elongated housing are maintained in secure contact with the charger contacts on the first side of the charger housing to hold the charger contacts in place against the flare contacts during a charging operation.

2. The apparatus of claim 1 wherein the flare produces a plurality of light patterns selected from the group comprising at least: (a) all LEDs turned on; (b) all LEDs flashing on and off in unison; (c) a first subgroup of LEDs flashing at a first time and a second subgroup of LEDs flashing at a second time, wherein the first and second subgroups of LEDs flash sequentially along the outer periphery of the elongated housing; and (d) a first subgroup of LEDs flashing at a first time, a second subgroup of LEDs flashing at a second time, and a third subgroup of LEDs flashing at a third time, wherein the first, second and third subgroups of LEDs flash sequentially along the outer periphery of the elongated housing.

3. The apparatus of claim 1 wherein the flare attachment device and the charger attachment device are magnets.

4. The apparatus of claim 1 further comprising a protective casing that fits over an outer surface of the elongated housing with a plurality of openings aligned with the positions of the LEDs.

5. The apparatus of claim 1 wherein the flare contacts are recessed in a protective casing on the housing.

6. The apparatus of claim 1 wherein the elongated housing further comprises a hanger protruding from the housing.

7. The apparatus of claim 1 wherein the elongated housing further comprises a plurality of LED windows that are integrated in the housing and aligned with the position of the LEDs, the windows being generally convex in shape to magnify the intensity of the light emitted from the LEDs.

8. The apparatus of claim 1 wherein for at least one position of a LED in the plurality of LEDs at least two LEDs are positioned.

9. The apparatus of claim 8 wherein the at least two LEDs are either stacked or adjacent to each other.

10. A system for providing a warning in low light conditions comprising:
- at least one LED flare including:
  - an elongated housing formed of a generally cylindrical shape and having a flat side;
  - a handle at one end of the elongated housing;
  - a plurality of LEDs positioned in a plurality of corresponding windows on opposing sides along the length of the generally cylindrically shaped elongated housing, wherein each of the plurality of windows is spaced apart at discrete intervals along the length of the housing relative to other windows;
  - a switch on the elongated housing for operating the flare;
  - a re-chargeable battery encased in the elongated housing for powering the flare;
  - a circuit encased in the elongated housing that is in electrical connection with the switch, the battery and the circuit for delivering power and operational control from the battery to the LEDs upon activation by the switch; and
  - flare contacts electrically connected to the battery and positioned on the flat side of the elongated housing for delivering a charge to the battery; and
- a carrying case including:
  - a first side with at least one slot having a flat recessed surface that is generally in the shape of the elongated housing for receiving the flat side of the elongated housing and holding the at least one LED flare securely in place in the first side;
  - charger contacts mounted in the flat recessed surface of the first side that are positioned to align with the flare contacts when the flare is placed in the slot; and
  - a second side that fits over the first side securely maintaining the at least one LED flare in place with the flare contacts on the flat side of the elongated housing in secure contact with the charger contacts in the slot of the first side of the case during a charging operation.

11. The system of claim 10 further comprising at least one flare stand.

12. The system of claim 11 wherein a flare stand comprises: at least three legs that are bound together at a first end; and a top affixed to the first end for holding the LED flare.

13. The system of claim 10 wherein the carrying case further comprises a recessed area for storing a charger adapter and cord.

14. The apparatus of claim 10 wherein the circuit further comprises a controller programmed to provide at least one flash pattern that is performed by the LEDs during operation of the flare.

15. The apparatus of claim 10 further comprising a protective casing that fits over an outer surface of the elongated housing with a plurality of openings aligned with the positions of the LEDs.

16. The apparatus of claim 10 wherein the flare contacts are recessed in a protective casing on the housing.

17. The apparatus of claim 10 wherein the elongated housing further comprises a plurality of LED windows that are integrated in the housing and aligned with the positions of the LEDs, the windows being generally convex in shape to magnify the intensity of the light emitted from the LEDs.

18. The apparatus of claim 10 wherein for at least one position of a LED in the plurality of LEDs at least two LEDs are positioned.

19. The apparatus of claim 10 wherein the flare produces a plurality of light patterns selected from the group comprising at least: (a) all LEDs turned on; (b) all LEDs flashing on and off in unison; (c) a first subgroup of LEDs flashing at a first time and a second subgroup of LEDs flashing at a second time, wherein the first and second subgroups of LEDs flash sequentially along the outer periphery of the elongated housing; and (d) a first subgroup of LEDs flashing at a first time, a second subgroup of LEDs flashing at a second time, and a third subgroup of LEDs flashing at a third time, wherein the first, second and third subgroups of LEDs flash sequentially along the outer periphery of the elongated housing.

20. The apparatus of claim 10 wherein the at least one LED flare further comprises an attachment device in the housing.

* * * * *